US007905483B2

(12) United States Patent
Murakami et al.

(10) Patent No.: US 7,905,483 B2
(45) Date of Patent: Mar. 15, 2011

(54) TRANSPORT DEVICE AND IMAGE FORMING APPARATUS

(75) Inventors: Junichi Murakami, Ebina (JP); Shuichi Nishide, Ebina (JP); Masahiro Sato, Ebina (JP); Atsuyuki Kitamura, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 57 days.

(21) Appl. No.: 12/405,638

(22) Filed: Mar. 17, 2009

(65) Prior Publication Data

US 2009/0295077 A1 Dec. 3, 2009

(30) Foreign Application Priority Data

May 30, 2008 (JP) ..... 2008-142096

(51) Int. Cl.
*B65H 9/16* (2006.01)

(52) U.S. Cl. ..... 271/251; 271/248; 271/250

(58) Field of Classification Search ..... 271/248, 271/250, 251, 241, 226, 234, 239
See application file for complete search history.

(56) References Cited

U.S. PATENT DOCUMENTS

| | | | | | |
|---|---|---|---|---|---|
| 4,432,541 | A | * | 2/1984 | Clark et al. | 271/251 |
| 4,775,142 | A | * | 10/1988 | Silverberg | 271/251 |
| 4,984,779 | A | * | 1/1991 | Iwasaki | 271/227 |
| 5,284,333 | A | * | 2/1994 | Ishikawa | 271/22 |
| 5,494,277 | A | * | 2/1996 | Flores | 271/251 |
| 5,657,983 | A | * | 8/1997 | Fisk | 271/251 |
| 5,967,511 | A | * | 10/1999 | Bell | 271/252 |
| 6,840,514 | B1 | * | 1/2005 | Westhoff | 271/248 |
| 2004/0188929 | A1 | * | 9/2004 | Tada et al. | 271/248 |

FOREIGN PATENT DOCUMENTS

| | | | | |
|---|---|---|---|---|
| JP | 57013584 | A | * | 1/1982 |
| JP | 58-119534 | A | | 7/1983 |
| JP | 62-126062 | A | | 6/1987 |
| JP | 04045041 | A | * | 2/1992 |
| JP | 04-371438 | A | | 12/1992 |

* cited by examiner

*Primary Examiner* — Stefanos Karmis
*Assistant Examiner* — Prasad V Gokhale
(74) *Attorney, Agent, or Firm* — Morgan, Lewis & Bockius LLP

(57) ABSTRACT

A transport device includes: a positioning member provided in a sheet transport path, used for positioning of a print sheet in a direction orthogonal to a sheet transport direction; and a skewed roller that transports the print sheet while skewing the print sheet toward a direction of the positioning member, a transport roller being provided in a position different from the skewed roller in the sheet transport direction.

11 Claims, 6 Drawing Sheets

TRANSPORT DEVICE AND IMAGE FORMING APPARATUS

CROSS-REFERENCE TO RELATED APPLICATION

This application is based on and claims priority under 35 USC 119 from Japanese Patent Application No. 2008-142096 filed May 30, 2008.

BACKGROUND

Technical Field

The present invention relates to a transport device and an image forming apparatus.

SUMMARY

According to an aspect of the invention, there is provided a transport device including: a positioning member provided in a sheet transport path, used for positioning of a print sheet in a direction orthogonal to a sheet transport direction; and a skewed roller that transports the print sheet while skewing the print sheet toward a direction of the positioning member, a transport roller being provided in a position different from the skewed roller in the sheet transport direction.

BRIEF DESCRIPTION OF THE DRAWINGS

An exemplary embodiment of the present invention will be described in detail based on the following figures, wherein.

DETAILED DESCRIPTION

Next, an exemplary embodiment of the present invention will be described based on the drawings.

Figure 1:
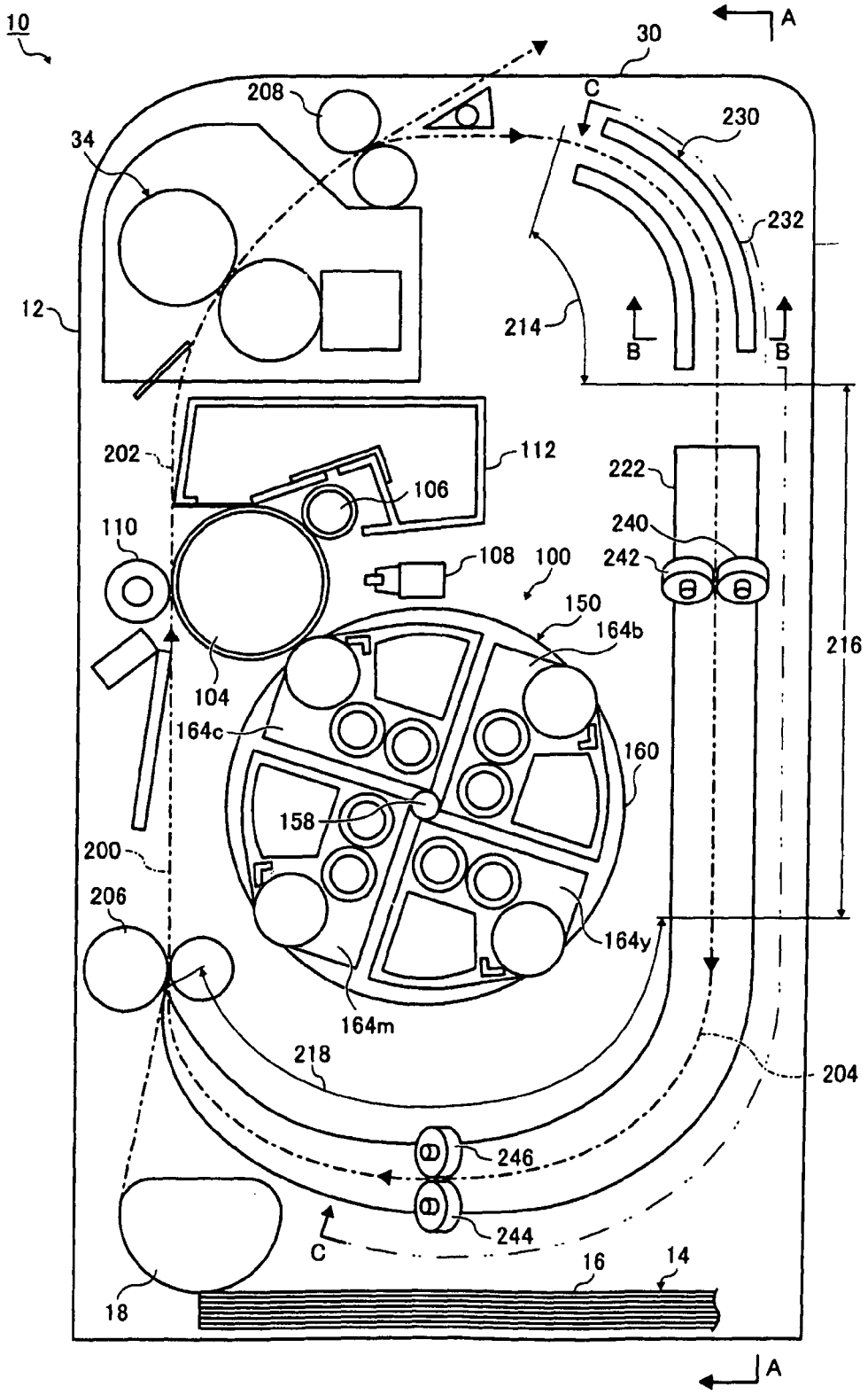
FIG. 1 is a left-side cross-sectional view schematically showing the structure of an image forming apparatus according to an exemplary embodiment of the present invention.
Figure 2:
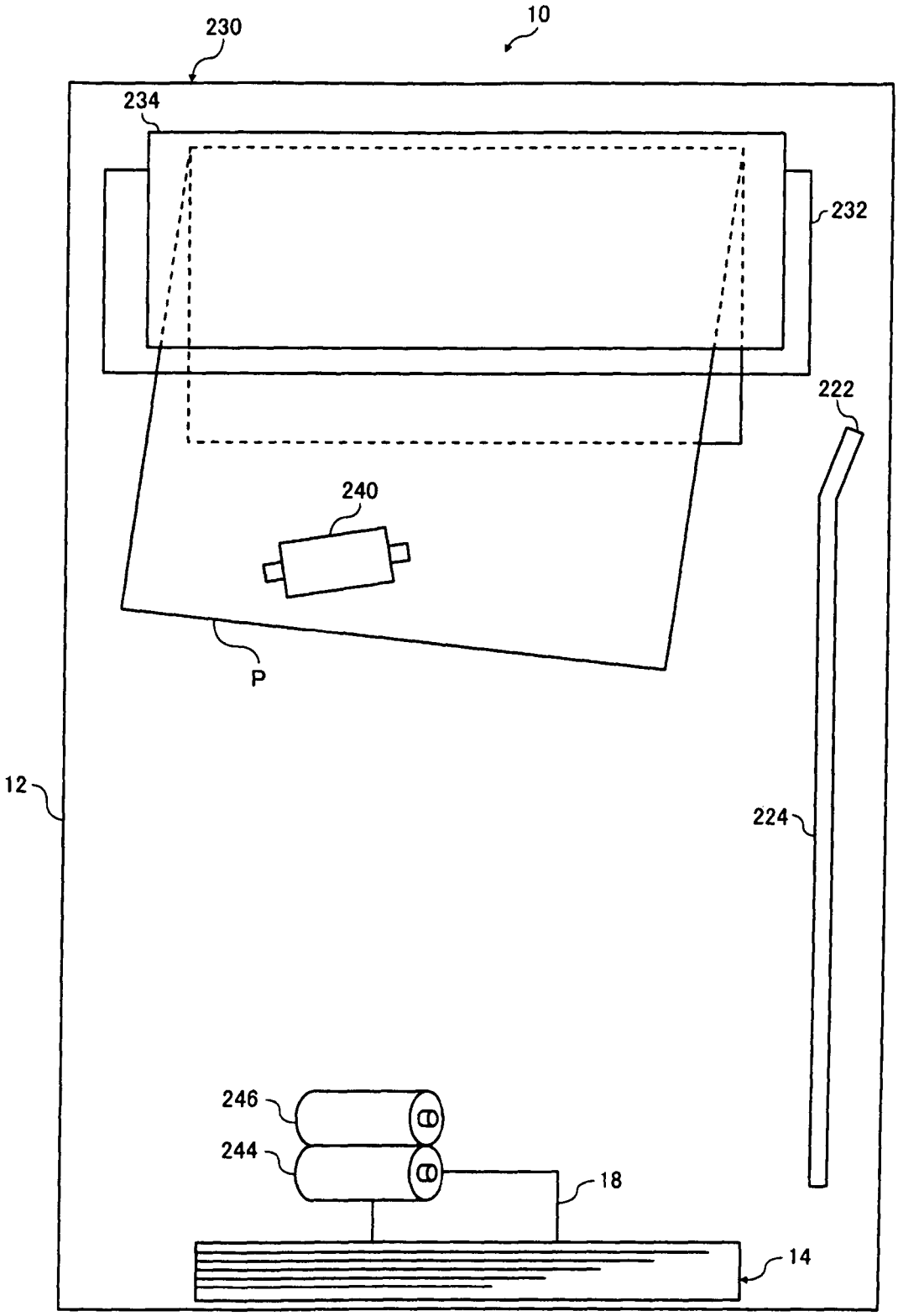
FIG. 2 is a cross-sectional view of the image forming apparatus according to the exemplary embodiment of the present invention along a line A-A in FIG. 1.

FIGS. 1 and 2 show an image forming apparatus 10 according to the exemplary embodiment of the present invention. The image forming apparatus 10 has an image forming apparatus main body 12. A sheet supply device 14 and an image forming unit 100 are attached in the image forming apparatus main body 12. Further, an upper part of the image forming apparatus main body 12 is used as a exit unit 30 to which a print sheet where image formation has been completed is output.

The sheet supply device 14 has a sheet container 16 where print sheets are stacked and a feed roller 18 to feed the print sheets from the sheet container 16 toward the image forming unit 100.

The image forming unit 100 has a photoreceptor 104 which is used as an image carrier, and which has e.g. a drum shape, a charging device 106 to uniformly charge the surface of the photoreceptor 104, a writing device 108 to irradiate the photoreceptor 104 charged by the charging device 106 with a laser beam thereby to write a latent image, a developing device 150 to develop the latent image written by the writing device 108 on the photoreceptor 104 and form a developer image on the surface of the photoreceptor 104, a transfer device 110 to transfer the developer image formed by the developing device 150 on the surface of the photoreceptor 104 to a print sheet, and a cleaning device 112 to remove developer and the like remaining on the surface of the photoreceptor 104 after the transfer of the developer image to the print sheet.

The developing device 150 has a developing device main body 160.

The developing device main body 160 is rotatably supported with a rotation shaft 158. In the developing device main body 160, four developer cartridges 164*y*, 164*m*, 164*c* and 164*b* are removably attached. The developer cartridge 164*y* contains a yellow developer; the developer cartridge 164*m* contains a magenta developer; the developer cartridge 164*c* contains a cyan developer; and the developer cartridge 164*b* contains a black developer. These developers are supplied to the surface of the photoreceptor 104, and used for development of a latent image formed on the surface of the photoreceptor 104.

Further, as the developing device main body 160 is rotated about the rotation shaft 158, one of the developer cartridges 164 provided in a position opposite to the photoreceptor 104 can be selected from the developer cartridges 164*y*, 164*m*, 164*c* and 164*b*. Then the developer is supplied to the photoreceptor 104 from the developer cartridge 164 provided in the position opposite to the photoreceptor 104.

Further, a transport path 200 having a main transport path 202 and a return path 204 is formed in the image forming apparatus main body 12.

The main transport path 202 is used for transport of a print sheet from a lower position toward an upper position in the gravitational direction. A registration roller 206, the above-described transfer device 110 and the photoreceptor 104, a fixing device 34, and a exit roller 208 are provided along the main transport path 202 sequentially from the upstream side in a sheet transport direction. The registration roller 206 is used for supply of a print sheet or the like sent from the feed roller 18 toward a contact portion between the photoreceptor 104 and the transfer device 110 at timing of image formation by the image forming unit 100.

The fixing device 34 is used for fixing a developer image transferred to a print sheet by the transfer device 110 to the print sheet using e.g. heat and pressure. The exit roller 208 is used for discharging the print sheet on which the developer image has been fixed by the fixing device 34 to the exit unit 30. The exit roller 208 is also used for supply of the print sheet on which the developer image has been fixed by the fixing device 34 to the return path 204.

The return path 204 is used to return a print sheet supplied by the exit roller 208 from the main transport path 202 to a position of the main transport path 202 in which the registration roller 206 is provided.

The return path 204 has a first curved area 214 positioned on the downstream side of the exit roller 208 in the sheet transport direction, in which a print sheet is transported in a curved state, a straight area 216 provided on the downstream side of the first curved area 214 in the sheet transport direction, in which the print sheet is transported approximately straight, and a second curved area 218 positioned on the downstream side of the straight area 216 in the sheet transport direction, in which the print sheet is transported in a curved state.

A positioning member 222 used for positioning is provided in plural different positions in the sheet transport direction on the right side of the transport path 200. The positioning member 222 is e.g. a plate member having a positioning surface 224 used as a reference surface for positioning of a print sheet in a direction orthogonal to the sheet transport direction, formed on the side opposite to the transport path 200.

In the present exemplary embodiment, the positioning member 222 is provided in one position on the right side of the straight area 216 and the second curved area 218 in the return path 204. It may be arranged such that total two positioning members are provided in the straight area 216 and the second curved area 218, and these two positioning members are used as the positioning members in plural different positions in the sheet transport direction.

The first curved area 214 of the return path 204 is provided with a pair of guide plates 230 used as a guide member to guide a print sheet. The pair of guide plates 230 have an outside guide plate 232 positioned outside a transported print sheet and an inside guide plate 234 positioned inside the transported print sheet. In the first curved area 214, a print sheet P is transported so as to be guided in space formed between the outside guide plate 232 and the inside guide plate 234. The details of the pair of guide plates 230 will be described later.

In the return path 204, a first skewed roller 240 used as a skewed roller to transport a print sheet while skewing the print sheet in the direction of the positioning member 222 and a first contact roller 242 opposite to the first skewed roller 240 and in contact with the first skewed roller 240, are provided in the straight area 216. Further, in the second curved area 218 of the return path 204, a second skewed roller 244 used as a skewed roller to transport a print sheet while skewing the print sheet in the direction of the positioning member 222, and a second contact roller 246 opposite to the second skewed roller 244 and in contact with the second skewed roller 244 are provided in the second curved area 218. As described above, the image forming apparatus 10 has plural skewed rollers, the first skewed roller 240 and the second skewed roller 244. The first skewed roller 240 and the second skewed roller 244 are provided in different positions in the sheet transport direction.

The first skewed roller 240 is used as a skewed roller in contact with a position of a print sheet on a straight line. The first skewed roller 240 is positioned on the upstream side in the sheet transport direction. On the other hand, the second skewed roller 244 is used as a skewed roller in contact with a curved portion of the print sheet. The second skewed roller 244 is positioned on the downstream side in the sheet transport direction.

In the image forming apparatus 10 having the above structure, a monochrome (black and white) image with the black developer and a multi-color image with the yellow, magenta, cyan and black developers, can be formed.

In formation of a monochrome image with the black developer, the surface of the photoreceptor 104 is uniformly charged by the charging device 106, then a latent image corresponding to a single color black image is written by the writing device 108 on the uniformly charged surface of the photoreceptor 104, and the latent image corresponding to the single color black image formed on the surface of the photoreceptor 104 is developed by the developing device 150 using the black developer.

That is, the developing device main body 160 is rotated about the rotation shaft 158 such that the developer cartridge 164*b* is provided in the position opposite to the photoreceptor 104. Then developer contained in the developer cartridge 164*b* is supplied to the photoreceptor 104, and the latent image corresponding to the black image written on the photoreceptor 104 is developed using the black developer.

Further, a print sheet is sent with the feed roller 18 toward the registration roller 206, and the print sheet is supplied to the contact portion between the photoreceptor 104 and the transfer device 110 at timing of image formation by the image forming unit 100. Then a black developer image formed on the surface of the photoreceptor 104 is transferred by the transfer device 110 to the supplied print sheet, then the developer image transferred on the print sheet is fixed by the fixing device 34 to the print sheet, and the print sheet on which the black developer image has been transferred is output by the exit roller 208 to the exit unit 30.

On the other hand, in formation of a multi-color image with the yellow, magenta, cyan and black developers, first, through approximately the same process as that of the above-described formation of the single color black image, a yellow developer image is formed on a print sheet. Note that in formation of the above-described single color black image, the black developer is supplied to the photoreceptor 104; in the case, however, the yellow developer contained in the developer cartridge 164*y* is supplied to the photoreceptor 104 and used for development.

The print sheet, on which the yellow developer image transferred by the transfer device 110 has been fixed by the fixing device 34, is not output by the exit roller 208 to the exit unit 30, but transported by the exit roller 208 to the return path 204. The print sheet transported to the return path 204 is guided with the pair of guide plates 230, then transported with the first skewed roller 240 and then transported with the second skewed roller 244, thus again supplied to the registration roller 206. Then, the print sheet supplied to the registration roller 206 is supplied to the contact portion between the photoreceptor 104 and the transfer device 110 at timing of formation of a magenta image by the image forming unit 100. Then, a magenta developer image is transferred onto the print sheet so as to be overlaid on the yellow developer image, and the magenta developer image is fixed by the fixing device 34 to the print sheet. Then, the print sheet on which the magenta developer image overlaid on the yellow developer image has been fixed is supplied through the return path 204 to the registration roller 206.

Hereinbelow, similarly, a cyan developer image is fixed, and further, a black developer image is fixed to the print sheet. Thereafter, the print sheet is output by the exit roller 208 to the exit unit 30.

As described above, the first skewed roller 240 and the second skewed roller 244 transport a print sheet while the rollers are both in contact with a surface of the print sheet on which a developer image (a yellow developer image, a magenta developer image and a cyan developer image) is transferred.

Figure 3A:
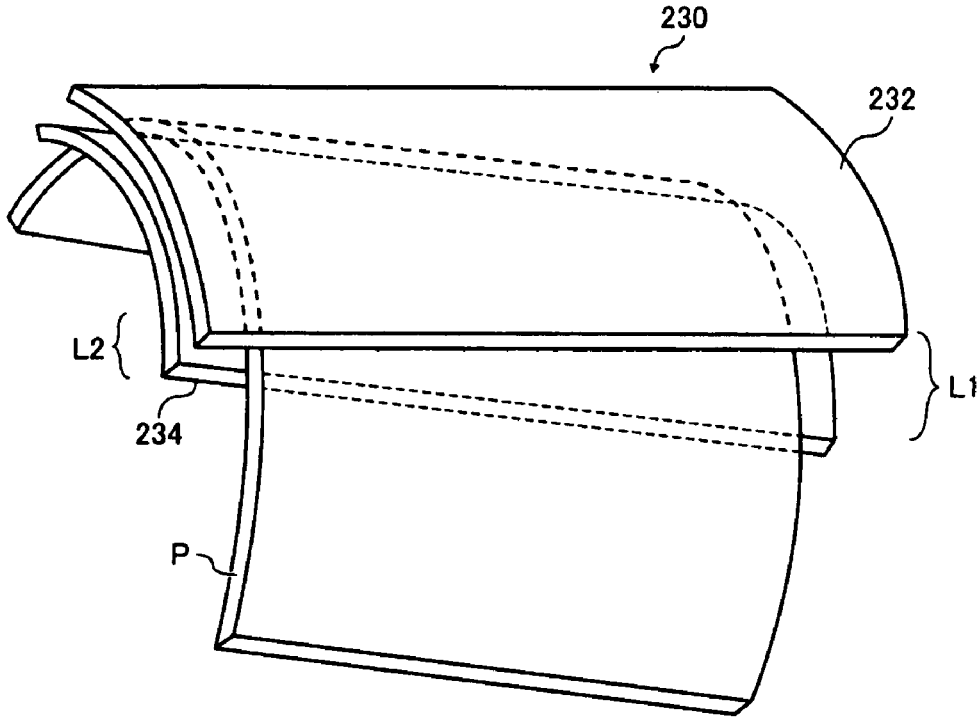
FIG. 3A is a perspective view of a guide member of the image forming apparatus according to the exemplary embodiment of the present invention viewed from a front left side.
Figure 3B:
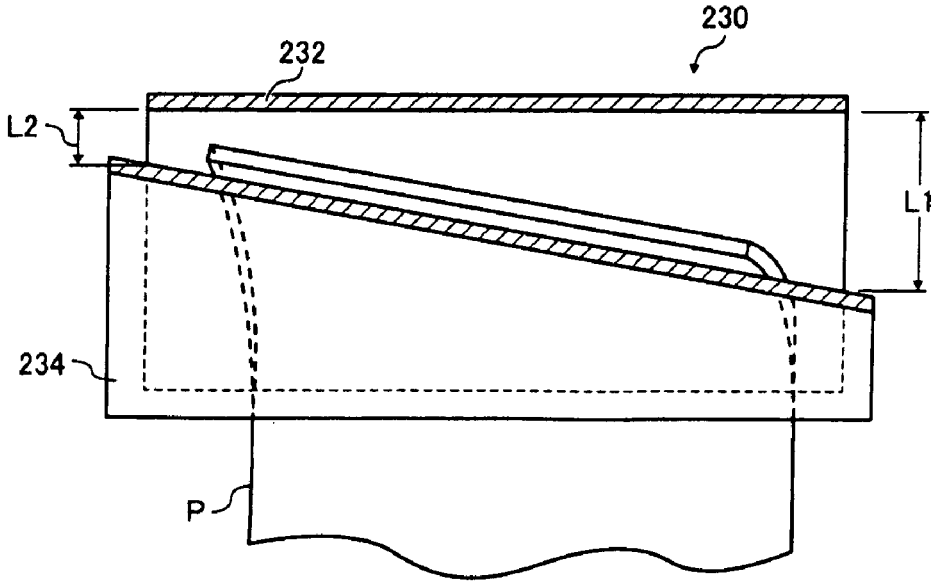
FIG. 3B is a cross-sectional view along a line B-B in FIG. 1.

FIGS. 3A and 3B show the pair of guide plates 230.

As shown in FIGS. 3A and 3B, in the interval between the outside guide plate 232 and the inside guide plate 234, a right interval L1 is wider than a left interval L2. In this arrangement, when e.g. the rear end side of the print sheet P is pushed with the exit roller 208 (see FIG. 1) frontward in the sheet transport direction in a state where at least the front end of a print sheet P is inserted between the outside guide plate 232 and the inside guide plate 234, the front end of the print sheet P is twisted to the left side along the surface of the inside guide plate 234, and transported in a state where the print sheet P is skewed leftward as shown in FIGS. 3A and 3B and FIG. 2. Accordingly, the print sheet P is gradually moved away from the positioning member 222 provided on the right side in the direction orthogonal to the sheet transport direction.

Figure 4:
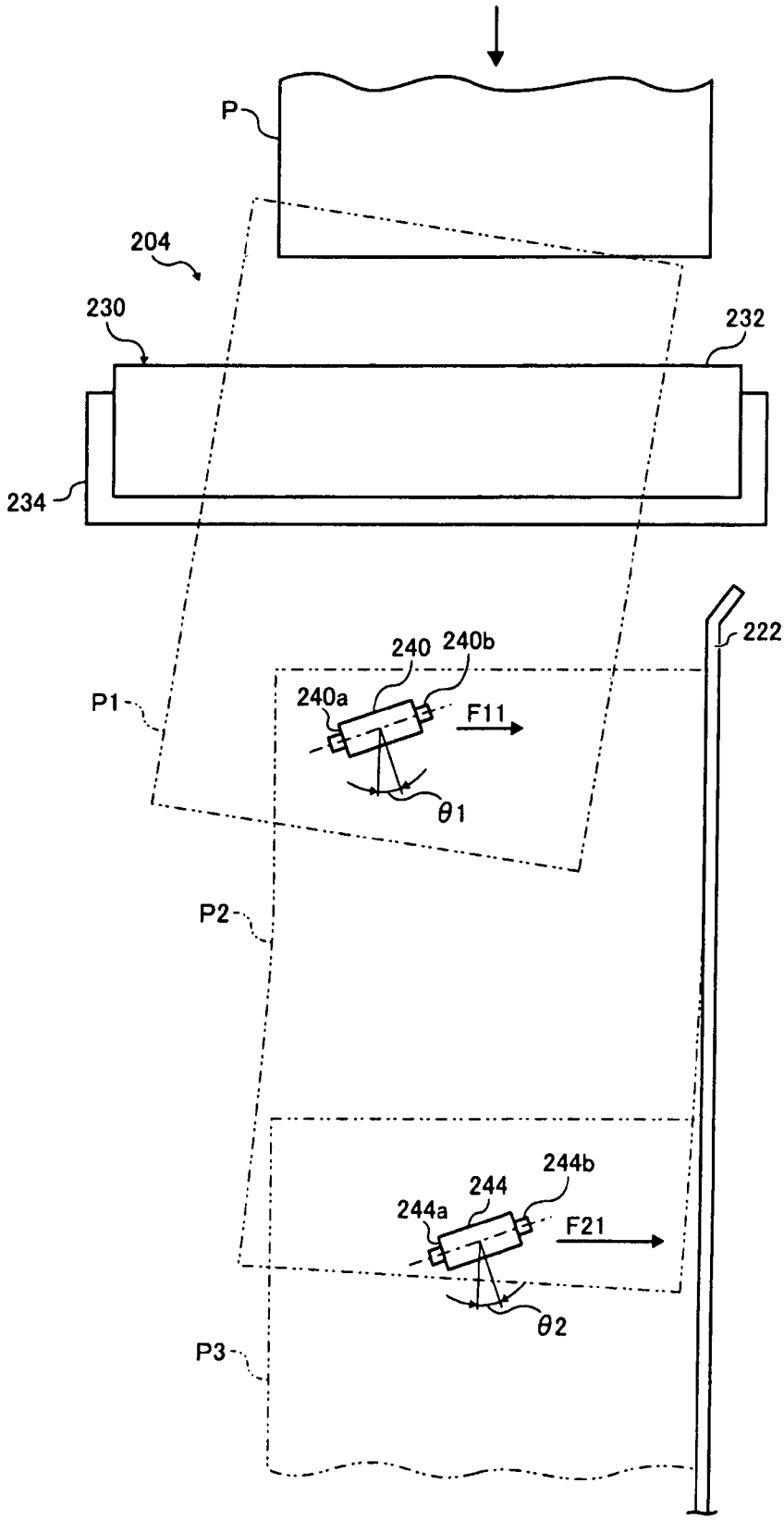
FIG. 4 is a cross-sectional view showing transport of a print sheet in the exemplary embodiment of the present invention, along a line C-C in FIG. 1.
Figure 5A:
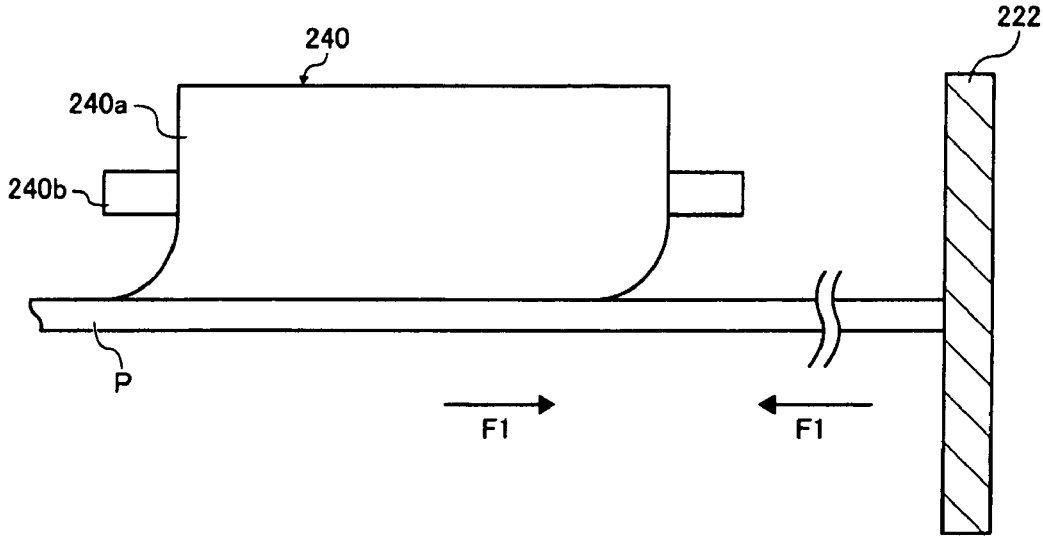
FIG. 5A is an explanatory view showing transport of the print sheet with a first skewed roller of the image forming apparatus according to the exemplary embodiment of the present invention.

FIG. 4 shows the print sheet P transported in the return path 204, and shows the first skewed roller 240 and the second skewed roller 244. Further, FIG. 5A shows the first skewed roller 240 transporting the print sheet, and FIG. 5B, the second skewed roller 244 transporting the print sheet.

As shown in FIG. 4, the first skewed roller 240 and the second skewed roller 244 are provided in an inclined state at respectively rightward angles θ1 and θ2 with respect to the sheet transport direction. The angles θ1 and θ2 are the same angles, within e.g. the range of 2° to 5°. In this manner, since the first skewed roller 240 and the second skewed roller 244 are inclined to the right side with respect to the sheet transport direction, the first skewed roller 240 and the second skewed roller 244 skew a print sheet to the right side, i.e., to the side of the positioning member 222.

The first skewed roller 240 has a main body 240*a* and a shaft 240*b*. The main body 240*a* having flexibility in the direction of the shaft 240*b*, is formed with an elastic material.

For example, as rubber which is a particular material of the main body 240*a*, ethylene-propylene diene rubber (EPDM), butadiene rubber, isoprene rubber, chloroprene rubber, natural rubber, acrylonitrile-butadiene rubber, styrene butadience rubber, styrene rubber, butyle rubber, haloid butyle rubber, polyisobutylene rubber, chlorosulfonated polyethylene rubber, acrylic rubber, urethane rubber, silicon rubber, polyether copolymer, epichlorohydrin copolymer, and the like, can be used. These rubbers may be used as the material of the main body 240*a* as a single material, or two or more types of these rubbers may be blended as the material of the main body 240*a*. Further, the elastic modulus of the main body 240*a* is set to e.g. 1.5 to 10 Mpa (megapascal) as a Young's modulus.

As the main body 240*a* has elasticity, when the right end of a print sheet transported while skewed rightward is brought into contact with the positioning member 222, the first skewed roller 240 is pushed with the print sheet P pushed with the positioning member 222, and a portion in contact with the print sheet P is distorted to the left side as shown in FIG. 5A. The force of the positioning member 222 to push the print sheet P and the force of the first skewed roller 240 to press the print sheet P against the positioning member 222 at this time are F1. Further, the transport force of the first skewed roller 240 to transport the print sheet P in the direction of the positioning member 222 is F11.

The second skewed roller 244 has a main body 244*a* and a shaft 244*b* as in the case of the first skewed roller 240. The main body 244*a* having flexibility in the direction of the shaft 244*b*, is formed with an elastic material.

For example, as in the case of the first skewed roller 240, as rubber which is a particular material of the main body 244*a*, ethylene-propylene diene rubber (EPDM), butadiene rubber, isoprene rubber, chloroprene rubber, natural rubber, acrylonitrile-butadiene rubber, styrene butadience rubber, styrene rubber, butyle rubber, haloid butyle rubber, polyisobutylene rubber, chlorosulfonated polyethylene rubber, acrylic rubber, urethane rubber, silicon rubber, polyether copolymer, epichlorohydrin copolymer, and the like, can be used. These rubbers may be used as the material of the main body 244*a* as a single material, or two or more types of these rubbers may be blended as the material of the main body 244*a*. Further, the elastic modulus of the main body 244*a* is set to e.g. 1.5 to 10 Mpa (megapascal) as a Young's modulus.

It is understood from a comparison between the first skewed roller 240 and the second skewed roller 244 that the Young's modulus of the main body 244*a* of the second skewed roller 244 is higher than that of the main body 240*a* of the first skewed roller 240, and in the second skewed roller 244, the elastic modulus in its axial direction is higher than that of the first skewed roller 240.

Figure 5B:
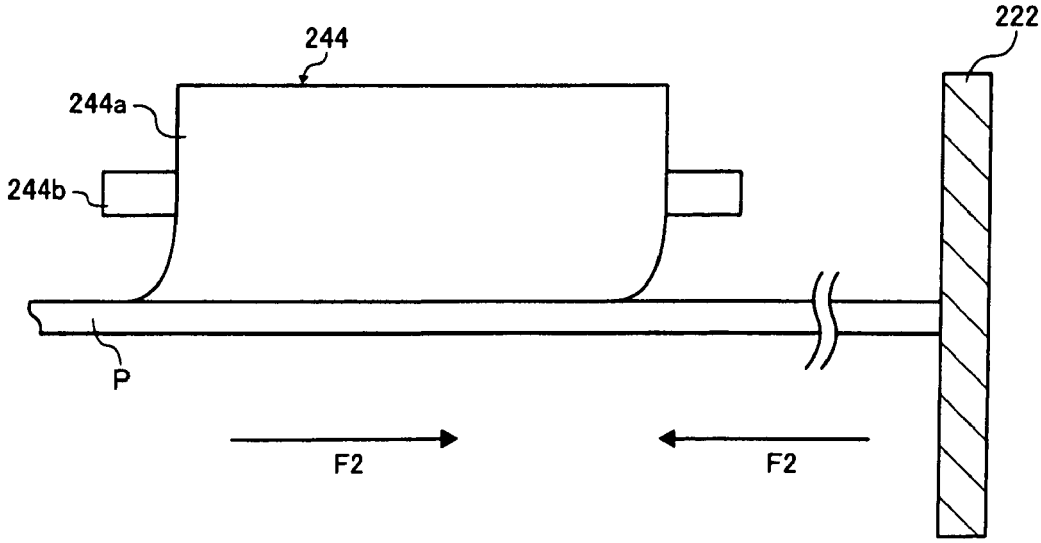
FIG. 5B is an explanatory view showing transport of the print sheet with a second skewed roller of the image forming apparatus according to the exemplary embodiment of the present invention.

As in the case of the first skewed roller 240, when the right end of the transported print sheet P while it is skewed rightward is brought into contact with the positioning member 222, the second skewed roller 244 is pushed with the print sheet P pushed with the positioning member 222, and a portion of the second skewed roller 244 in contact with the print sheet P is distorted to the left side as shown in FIG. 5B. The force of the positioning member 222 to push the print sheet P and the force of the second skewed roller 244 to press the print sheet P against the positioning member 222 at this time are F2. Further, the transport force of the second skewed roller 244 to transport the print sheet P in the direction of the positioning member 222 is F21.

The elastic modulus of the main body of the first skewed roller 240 is lower than that of the second skewed roller 244. Accordingly, in comparison with the second skewed roller 244, distortion occurred in the first skewed roller 240 is greater. Even when the force F21 is set to a higher level than the force F11, twist of a print sheet between the skewed rollers and/or slip of the print sheet can be prevented by the distortion of the first skewed roller 240. Further, as the force F1 is set to a low level, buckling of the print sheet can be prevented.

In the image forming apparatus 10 having the above arrangement, when the print sheet P, pushed with the exit roller 208, is inserted from its front end between the outside guide plate 232 and the inside guide plate 234, the print sheet P is moved while it is skewed leftward in the return path 204 along the inside guide plate 234 as indicated with an alternate long and two short dashes line in FIG. 4 as a position P1.

Then, when the front end of the print sheet P arrives at the position of the first skewed roller 240, the print sheet P moved while skewed leftward is transported with the first skewed roller 240 while it is skewed rightward toward the direction of the positioning member 222. Then the print sheet P is brought into contact with the positioning member 222 from the rear end of its right side, and as indicated with an alternate long and two short dashes line in FIG. 4 as a position P2, pressed against the positioning member 222.

In this manner, since the print sheet is in contact with the first skewed roller 240 and the second skewed roller 244 simultaneously in the position P2, the position can be stably controlled.

Next, when the front end of the print sheet P arrives at the second skewed roller 244, the print sheet P is transported with the second skewed roller 244 while it is skewed rightward toward the direction of the positioning member 222, and pressed against the positioning member 222. As the print sheet P is pressed against the positioning member 222 with the plural skewed rollers, i.e., the first skewed roller 240 and the second skewed roller 244, the print sheet P is positioned in a direction orthogonal to the sheet transport direction of the print sheet P as indicated with an alternate long and two short dashes line in FIG. 4 as a position P3.

As described above, in the image forming apparatus 10 according to the present exemplary embodiment, as the print sheet P is pressed against the positioning member 222 using the plural skewed rollers, the force of the first skewed roller 240 to transport the print sheet P in the direction of the positioning member 222 (the transport force F11), and the force of the second skewed roller 244 to transport the print sheet P in the direction of the positioning member 222 (the transport force F21), can be set to a lower level in comparison with a case where the print sheet P is pressed against the positioning member 222 using only one skewed roller. As the transport force F11 and the transport force F21 can be set to a low value, the pressing forces F1 and F2 can be set to low values, and buckling of the print sheet P can be reliably prevented.

Further, in the image forming apparatus 10 according to the present exemplary embodiment, the transport force F21 of the second skewed roller 244 provided in the second curved area 218 in the return path 204 and in contact with a curved position of the print sheet P is higher than the transport force F11 of the first skewed roller 240 provided in the straight area 216 in the return path 204 and in contact with the straight position of the print sheet P. Accordingly, the probability of failure of positioning of the print sheet P and/or damage to the right end of the print sheet P such as buckling is low. On the other hand, in a case where the right end of the print sheet P is pressed against the positioning member 222 with the same force regardless of position and/or print sheet state, when the force pressing the print sheet P against the positioning member 222 is insufficient, the positioning of the print sheet P fails, while when the pressing force is too strong, damage such as buckling occurs in the right end of the print sheet P.

Further, the distortion that occurs in the first skewed roller 240 is larger in comparison with the distortion that occurs in the second skewed roller 244. Since the first skewed roller 240 absorbs twist of the print sheet P between the skewed rollers and and/or slip of the print sheet, damage such as a napped state of the print sheet P can be suppressed. Further, although the first skewed roller 240 and the second skewed roller 244 come into contact with a surface of the print sheet on which a developer image has been transferred, degradation of image quality of the developer image transferred on the print sheet is suppressed.

Particularly, in the present exemplary embodiment, in which images in respective colors are transferred and fixed onto a print sheet in formation of an image in multiple colors, the amount of transferred and fixed image differs by each color on the print sheet transported to the return path 204. However, it is found in the above arrangement that the degradation of image quality is suppressed in every transport process.

Figure 6:
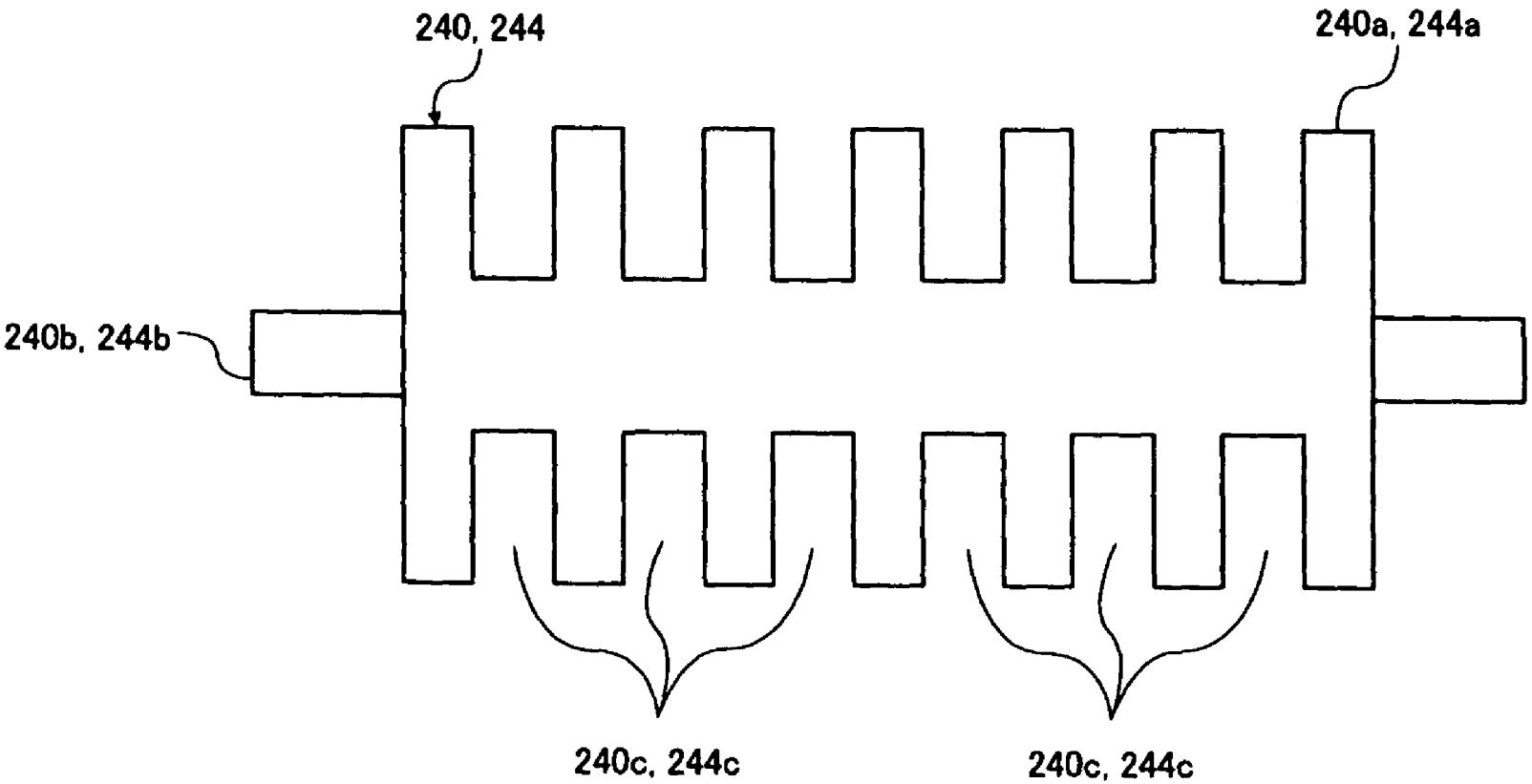
FIG. 6 illustrates a modification of the first skewed roller and the second skewed roller used in the exemplary embodiment of the present invention.

FIG. 6 shows a modification of the first skewed roller 240 and the second skewed roller 244. In the modification, plural grooves 240*c* and 244*c*, for example, are formed in the main bodies 240*a* and 244*a* of the first skewed roller 240 and the second skewed roller 244 in e.g. a direction orthogonal to the shaft 240*b* and the shaft 244*b*. In this arrangement, the first skewed roller 240 and the second skewed roller 244 are easily elastic-deformed in the axial direction.

In the above-described image forming apparatus 10, the transport force F11 of the first skewed roller 240 and the transport force F21 of the second skewed roller 244 are set to mutually different values. To set the transport force F21 to a value greater than the transport force F11, the inclination θ2 (see FIG. 4) of the second skewed roller 244 is set to a wider angle than the inclination θ1 (see FIG. 4) of the first skewed roller 240. Further, the transport force F21 may be set to a greater value than the transport force F11 by setting a friction coefficient on the surface of the main body 244*a* of the second skewed roller 244 to a greater value than that of the main body 240*a* of the first skewed roller 240.

Further, in the exemplary embodiment, the first skewed roller 240 and the second skewed roller 244 are both skewed rollers. However, it may be arranged such that one of these rollers is a transport roller as long as the other roller, namely the skewed roller, has a strong transport force to skew the print sheet.

As described above, the present invention is applicable to an image forming apparatus such as a duplicator, a facsimile apparatus, a copier and the like and a transport device used in e.g. these image forming apparatuses.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a positioning member provided in a sheet transport path, used for positioning of a print sheet in a direction orthogonal to a sheet transport direction; and a skewed roller that transports the print sheet while skewing the print sheet toward a direction of the positioning member, a transport roller being provided in a position different from the skewed roller in the sheet transport direction, wherein an elastic modulus in an axial direction of one of the skewed roller and the transport roller positioned downstream of the other in the sheet transport direction is higher than the other.

2. The transport device according to claim 1, wherein the transport roller has a function of the skewed roller.

3. The transport device according to claim 2, wherein the skewed roller is in contact with the print sheet in an area where the print sheet is transported while being curved in the sheet transport path and the transport roller is in contact with the print sheet in an area where the print sheet is straight-transported, and a transport force of the skewed roller to transport the print sheet in a direction toward the positioning member is set to a higher level than a level of a transport force of the transport roller to transport the print sheet in a direction toward the positioning member.

4. The transport device according to claim 2, wherein a transport force, for transporting the print sheet in the direction toward the positioning member, of one of the skewed roller and the transport roller positioned downstream of the other in the sheet transport direction is set to a higher level than the other.

5. The transport device according to claim 1, wherein a distance between the skewed roller and the transport roller is determined so as to bring the transported print sheet into contact with the skewed roller and the transport roller simultaneously.

6. The transport device according to claim 1, wherein the skewed roller and the transport roller are in contact with a surface of the print sheet where a developer image is transferred.

7. An image forming apparatus comprising:

a transport device that transports a print sheet; and an image forming unit that forms an image on the print sheet transported by the transport device, the transport device having:

a positioning member provided in a sheet transport path and used for positioning of the print sheet in a direction orthogonal to a sheet transport direction; and a skewed roller that transports the print sheet while skewing the print sheet toward a direction of the positioning member, and a transport roller being provided in a position different from the skewed roller in the sheet transport direction, wherein an elastic modulus in an axial direction of one of the skewed roller and the transport roller positioned downstream of the other in the sheet transport direction is higher than the other.

8. The image forming apparatus according to claim 7, wherein the transport roller has a function of the skewed roller.

9. The image forming apparatus according to claim 7, wherein a distance between the skewed roller and the transport roller is determined so as to bring the transported print sheet into contact with the skewed roller and the transport roller simultaneously.

10. The image forming apparatus according to claim 7, wherein the transport device circulates the print sheet on which image formation has been made by the image forming unit, and again supplies the print sheet to the image forming unit.

11. The image forming apparatus according to claim 10, wherein the image forming unit is capable of forming images in a plurality of colors, and the image forming unit repeats processes of transfer and fixing of each color image to the print sheet.

* * * * *